US006313444B1

(12) United States Patent
Sprague

(10) Patent No.: US 6,313,444 B1
(45) Date of Patent: Nov. 6, 2001

(54) RADIANT OVEN

(75) Inventor: Philip S. Sprague, N. Olmsted, OH (US)

(73) Assignee: C. A. Litzler Co., Inc., Cleveland, OH (US)

( * ) Notice: Subject to any disclaimer, the term of this patent is extended or adjusted under 35 U.S.C. 154(b) by 0 days.

(21) Appl. No.: 09/644,403

(22) Filed: Aug. 23, 2000

Related U.S. Application Data

(60) Provisional application No. 60/150,479, filed on Aug. 24, 1999.

(51) Int. Cl.[7] ..... F27B 9/28; F27B 9/34; F27B 9/36

(52) U.S. Cl. ..... 219/405; 219/388; 219/411; 34/274; 34/273

(58) Field of Search ..... 219/388, 405, 219/407; 432/59; 34/208, 209, 267, 273, 274, 467, 545; 373/119

(56) References Cited

U.S. PATENT DOCUMENTS

| | | | | |
|---|---|---|---|---|
| 3,492,378 | | 1/1970 | Simoncic . | |
| 3,744,963 | | 7/1973 | Flynn . | |
| 4,100,004 | | 7/1978 | Moss et al. . | |
| 4,411,075 | * | 10/1983 | Blaudszun | 219/388 |
| 4,416,624 | * | 11/1983 | Bloom | 432/134 |
| 4,554,437 | * | 11/1985 | Wagner et al. | 219/388 |
| 4,559,010 | | 12/1985 | Katsuki et al. . | |
| 4,574,182 | * | 3/1986 | Pescatore et al. | 219/388 |
| 4,610,860 | | 9/1986 | Mullen . | |
| 4,638,572 | * | 1/1987 | Fleissner | 34/273 |
| 4,757,184 | * | 7/1988 | Swanson et al. | 219/400 |
| 5,193,996 | | 3/1993 | Mullen . | |
| 5,495,092 | * | 2/1996 | Marschke et al. | 219/388 |
| 5,703,901 | * | 12/1997 | Ohtani et al. | 373/109 |
| 5,847,362 | * | 12/1998 | Sissons et al. | 219/388 |
| 5,937,540 | * | 8/1999 | Lee | 34/267 |
| 6,027,337 | | 2/2000 | Rogers et al. . | |
| 6,087,634 | * | 7/2000 | Cook et al. | 219/411 |

FOREIGN PATENT DOCUMENTS 55-152537 * 11/1980 (JP) .

* cited by examiner

*Primary Examiner*—Joseph Pelham
(74) *Attorney, Agent, or Firm*—Pearne & Gordon LLP

(57) ABSTRACT

A radiant oven for treating a web of material has oven chambers, electric radiant heaters and buffer plates. The material treated in the oven chamber is isolated from the heaters by the buffer plates. The buffer plates also prevent solvent vapors from reaching the heaters. This invention allows the use of nonclassified electric radiant heaters to treat material in a classified oven chamber.

18 Claims, 3 Drawing Sheets

RADIANT OVEN

This application claims the benefit of U.S. Provisional Application Serial No. 60/150,479, filed Aug. 24, 1999.

FIELD OF THE INVENTION

The present invention relates to a radiant oven and more particularly to a radiant web-treating or fabric-treating oven.

BACKGROUND OF THE INVENTION

Radiant ovens generate heat by the use of radiant heaters. In many radiant ovens the radiant heaters are contained in the same oven cavity where the item to be heated is placed. While this is acceptable in many applications, in some cases the item to be heated should not be directly exposed to an electric radiant heater. An example of this is heat-treatment of solvent-laden fabric or web.

In treating web or fabric, it is often necessary to heat the web or fabric to drive off solvent. The solvent vapors can create a fire or explosion hazard, however, if they contact a heating element, especially if failure of the heating element creates a short circuit or other source of ignition. The area of the oven in which solvent vapors accumulate is referred to as the classified area. Spaces that remain free of solvent vapors are referred to as nonclassified areas.

To avoid the fire or explosion hazard caused by solvent vapors, special classified electric radiant heaters are used. Classified electric radiant heaters are designed to be used in classified areas of an oven and reduce or eliminate the possibility of solvent ignition. The drawback to their use is their increased cost.

To reduce expense and improve maintainability, it would be advantageous to be able to use nonclassified electric radiant heaters in or adjacent to the classified area of ae web- or fabric-treating oven. There is a need for a radiant oven utilizing nonclassified electric radiant heaters that can treat items in situations that heretofore required the use of classified electric radiant heaters.

SUMMARY OF THE INVENTION

A radiant oven is provided for treating material. The oven has electric radiant heaters, oven walls, and radiant buffer plates. The buffer plates and oven walls define an oven chamber. During operation the oven chamber is a classified area, and is separated from the nonclassified area by the oven walls and buffer plates. At least one electric radiant heater is located in the nonclassified area.

DETAILED DESCRIPTION OF THE PREFERRED EMBODIMENTS OF THE INVENTION

In the description that follows, when a preferred range, such as 5 to 25, is given, this means preferably at least 5, and separately and independently, preferably not more than 25.

Any reference to a web of material to be treated also contemplates and includes treatment of a fiber or other continuous product.

The present invention generally relates to ovens used to treat a product. The product typically is a fiber or web. The illustrated embodiment is a radiant oven used to treat epoxy-impregnated fiberglass web, but other types of ovens and machinery are within the scope of the present invention.

Figure 1:
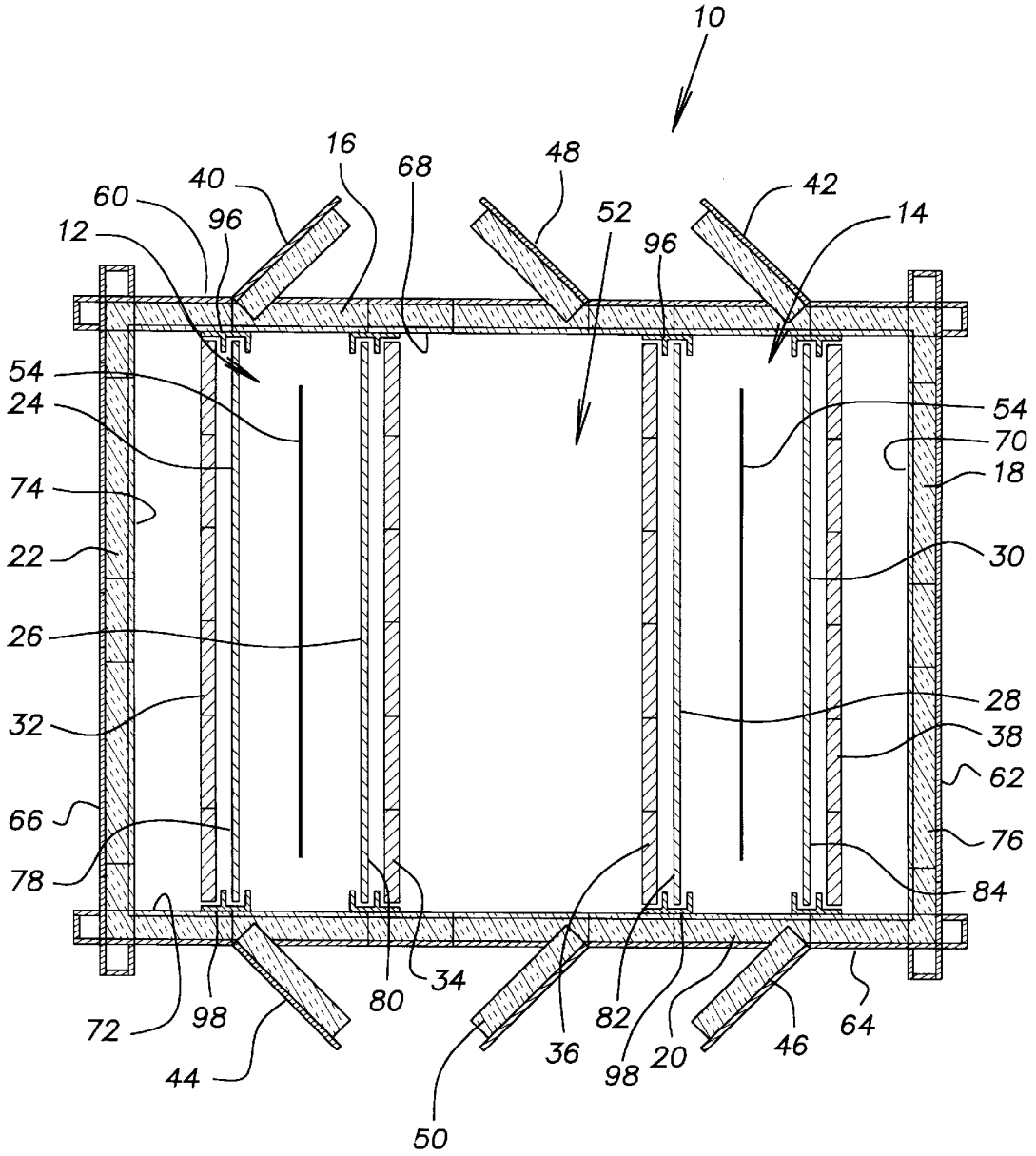
FIG. 1 is a plan view of an oven according to the invention, presented in cross section, taken along line 1—1 in FIG. 3.

Referring to FIG. 1, the oven 10 has at least two oven chambers 12, 14 wherein the web is processed and treated by radiant energy. The oven chambers are generally parallel-epipedic. In this view the oven chambers are bounded by side walls 16, 20 and buffer plates 24, 26, 28, 30. Electric radiant heaters 32, 34, 36, 38 are situated adjacent to either side of the oven chambers and transmit heat to the oven chambers through the buffer plates. The electric radiant heaters are typically 1 to 24 inches away from the radiant buffer plates, more preferably 1.5 to 8 inches away from the radiant buffer plates, more preferably 2 to 4 inches away from the radiant buffer plates. Suitable nonclassified electric radiant heaters are known in the art. Doors 40, 42, 44, 46 allow access to the oven chambers and doors 48, 50 allow access to the heaters 34, 36 and the area 52 between the oven chambers. Additional access doors in oven walls 18 and 22 allow access to electric radiant heaters 32 and 38. The oven overall is typically 12 feet by 8 feet in area covered and 24 feet in height.

Although the illustrated embodiment is eight feet in depth, it should be noted that this dimension is dependent largely on the width of the web to be treated. In general, this dimension will be approximately equal to the width of the web to be treated plus three feet. In addition, the height of 24 feet is highly variable, depending on the desired parameters of treatment. As a practical matter, the oven may be constructed as a series of modules that are vertically stacked to arrive at the desired height. Each module would typically be 7 to 10 feet in height, allowing a normally sized person to enter the module for maintenance purposes. An oven 24 feet in height could then be constructed from three modules, each 8 feet in height. It is generally necessary to construct a taller oven to maintain an adequate duration of treatment in the oven when increasing the rate of product treated. A typical ratio of desired treatment rate (per minute) to required oven height is 1.5. That is, the oven must be at least one foot tall for every 1.5 feet of web to be treated per minute.

The temperature of the electric radiant heaters 32, 34, 36, 38 is variable and is controlled by radiant buffer plate surface temperature sensing and closed loop feedback means known to the art. The mechanism acts to increase or decrease power to the heaters in order to maintain the buffer plates 24, 26, 28, 30 at a temperature preferably between 400° F. and 700° F. and more preferably between 500° F. and 600° F. The illustrated heaters may comprise a number of heater sub-units, each of which may have independent temperature sensing and closed feedback means. In this manner, different temperature zones may be established by the heater sub-units. It is often desirable for the heater sub-units near the edge of the radiant buffer plate to operate at a higher temperature than the sub-units near the center of the radiant buffer plate. This multiple cross-web zoning of electric radiant heaters acts to maintain a more constant temperature across the width of the radiant buffer plate, promoting uniform treatment of the product.

The air temperature in the oven chambers 12, 14 is preferably between 400° F. and 700° F. and more preferably between 500° F. and 600° F.

Figure 3:
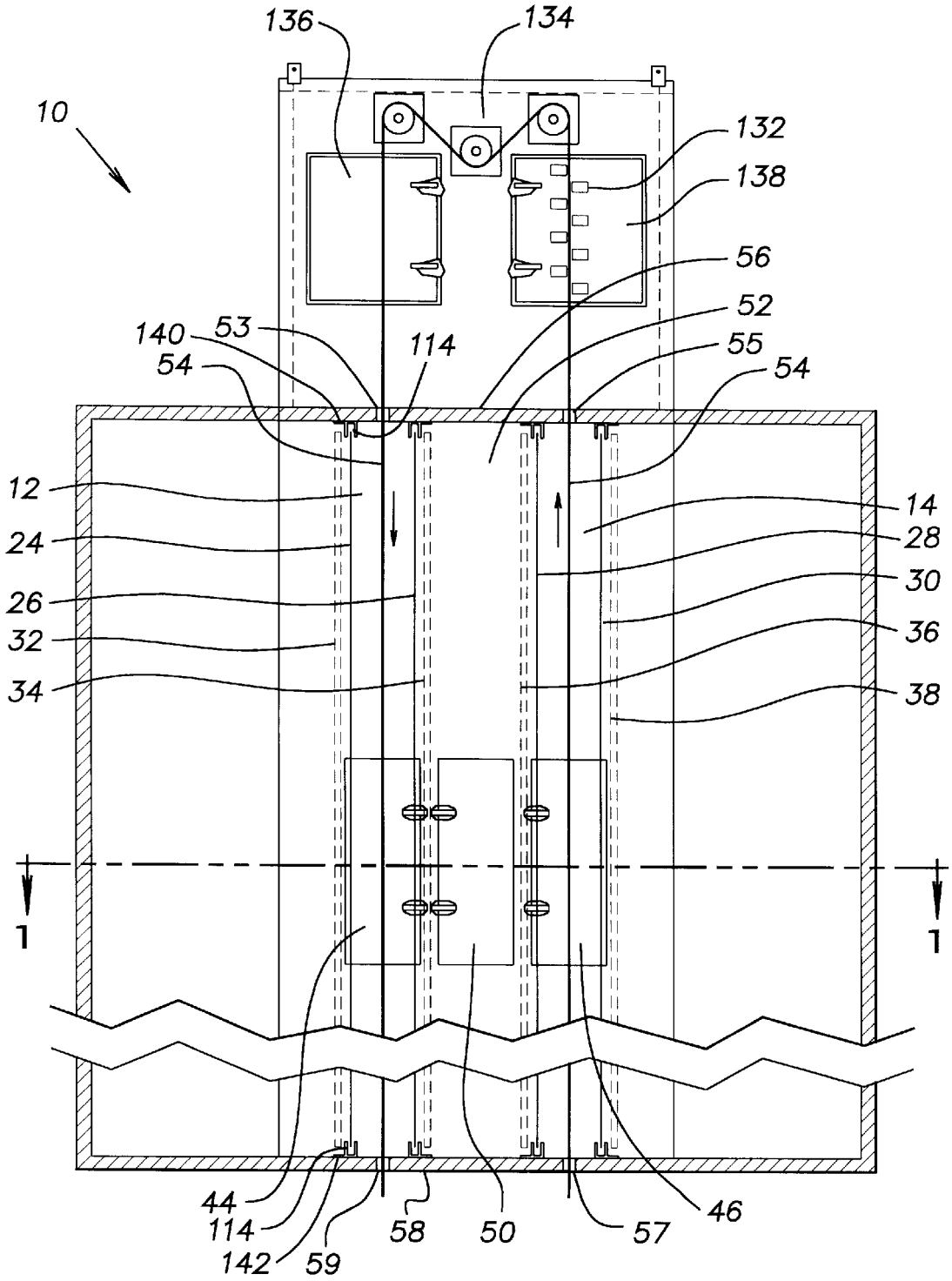
FIG. 3 is an elevational side view of an interior portion of an oven of the present invention.

Referring to FIG. 3, the web 54 treated in the oven is typically woven fiberglass weighing between 0.55 and 6.03 ounces per square yard, up to 56 inches wide. Other webs, fibers and bundles of fibers to be treated in such ovens are known in the art. Treatment of significantly wider webs would require the construction of a deeper oven chamber. In this view, the oven chambers 12, 14 are bounded by the buffer plates 24, 26, 28, 30, the top wall 56 and the bottom wall 58. The distance from the web to the buffer plates is typically 6 to 15 inches, more preferably 9 to 12 inches. It is usually preferable that the width of the radiant buffer plate is greater than the width of the web at each edge by an amount at least equal to the distance between the web and the radiant buffer plate. This is desirable to maintain uniform treatment across the width of the web. Because of this, it is preferable to limit the distance between the buffer plates and the web. At the same time, a certain minimum distance between the radiant buffer plates and web (and thus between the buffer plates) must be maintained to allow a person access between the plates for cleaning or other maintenance.

The web is typically unwound from a turret letoff from 24 to 30 inch diameter rolls. The web can be spliced using splice tape set with heat and pressure, allowing formation of a continuous web from several discontinuous rolls. The web can be accumulated so the oven can continue processing while the web letoff is stopped for splicing. The web is saturated with epoxy resin or other resins or materials known in the art before being treated in the oven. The epoxy resin is a mixture of resin solids and several organic solvents. The percentage of resin solids in the impregnation dip is preferably in the range of 40% to 60% by weight. After being saturated with epoxy resin the web is metered to final thickness using metering rolls or bars. After treatment of the web, the final product is made up of preferably 30% to 60% resin by weight, more preferably 40% to 50% resin by weight.

Referring again to FIG. 1, the oven walls 16, 18, 20, 22 are typically 2 to 4 inches thick. The exterior surfaces of the oven 60, 62, 64, 66 are preferably aluminized steel sheets, while the interior metal surfaces of the oven 68, 70, 72, 74 are preferably stainless steel sheets. These exterior sheets and interior sheets are preferably 16 to 22 gauge 0.0613 to 0.0306 inches thick steel sheets and more preferably 18 to 20 gauge 0.0490 to 0.0368 inches thick steel sheets. Insulating material 76 inside the panels between the interior sheets and exterior sheets of the oven is typically composed of mineral wool weighing approximately 6 pounds per cubic foot.

Each of the buffer plates 24, 26, 28, 30 has an oxidized finish on the side facing an oven cavity 12, 14 and a layer of high emissivity paint 78, 80, 82, 84 on the side facing a heater 32, 34, 36, 38 to aid in radiant heat transfer. To minimize the danger of contamination of the product, paint is not applied to the sides of the buffer plates facing the oven cavities and the web 54. The paint is preferably high emissivity black paint, preferably Pyromark 1200 Flat Black, a high temperature resistant silicone modified polymer coating available from the Tempil Division of Air Liquide America Corp., or similar paint. The buffer plates are preferably 8 to 18 gauge 0.1685 to 0.0490 inches thick steel plates, more preferably 10 to 16 gauge 0.1379 to 0.0613 inches thick steel plates, and most preferably 12 to 14 gauge 0.1072 to 0.0766 inches thick steel plates.

Figure 2:
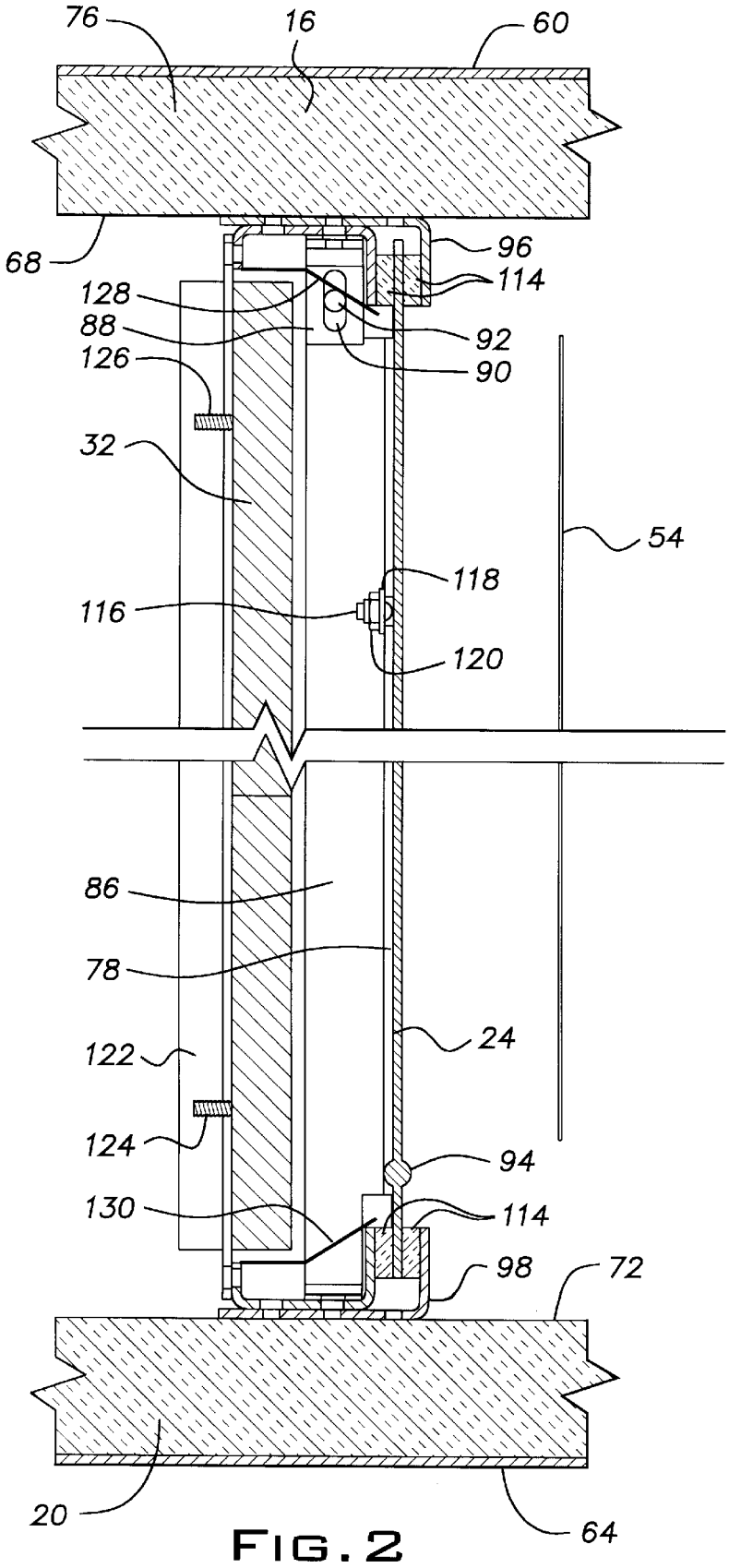
FIG. 2 is a plan view of one heater and buffer plate assembly, presented in cross section, taken along a portion of line 1—1 in FIG. 3.

Referring to FIG. 2, a buffer support angle 86, which in cross-section is L-shaped, is mounted at one end to an oven panel 20 by a stud or bolt. One arm of the L is substantially parallel to and facing the buffer plate. The other arm of the L is substantially parallel to the bottom wall of the oven 10.

The other end of the buffer support angle is supported in a mount 88 which is bolted to an opposing oven wall 16. A slot 90 in the mount receives a stud 92 projecting from the angle 86, and permits sliding motion as the angle 86 expands under the influence of the electric radiant heater 32.

The buffer plate 24 is secured to the buffer support angle 86 at an anchor point 94. In operation the buffer plates 24, 26, 28, 30 can be expected to exhibit horizontal expansion and vertical expansion based on the buffer plate size and oven operating temperature. As mentioned above, the oven may be constructed using series of modules. In such cases an oven chamber may be bounded on a given side by either a single buffer plate or a series of buffer plates mounted one above the other. Thus, the height of a buffer plate is dependent on the method oven construction. As also mentioned above, the width of the web to be treated is variable; the width of the buffer plate is thus dependent on the width of the web to be treated as well as the distance between the buffer plate and the web, as discussed above.

Because of the thermal expansion of the buffer plate, the plate is not mounted flush against the oven walls 16, 20, 56, 58. Brackets 96, 98 are mounted against the oven walls to receive the edges of the buffer plates. Insulating sealant 114 between the buffer plate and brackets is provided to maintain the integrity of the seal between the classified and nonclassified areas of the oven while allowing expansion of the buffer plates. The insulating sealant 114 is typically fiberglass tape. Referring to FIG. 3, the same system of brackets and insulating sealant is used to maintain a seal between the buffer plate and oven top wall 56 and oven bottom wall 58. Bracket 140 is mounted on the top wall to receive the top surface of buffer plate 24, and bracket 142 is mounted on the bottom wall to receive the bottom surface of buffer plate 24. Insulating sealant 114 is disposed between the brackets and the buffer plate surfaces to maintain the integrity of the seal between the classified and nonclassified areas of the oven while allowing expansion of the buffer plates. A similar arrangement maintains the seals at the top and bottom of buffer plates 26, 28 and 30. If the oven is constructed using multiple buffer plates mounted above one another, as discussed above, then each buffer plate would require a separate set of brackets and insulating sealant to successfully separate the classified and nonclassified spaces of the radiant oven. As shown herein, the use of the insulating sealant in combination with the buffer plates isolates the electric radiant heaters from the oven chamber and effectively separates the classified oven chamber from the nonclassified area in which the electric radiant heater is disposed.

Because the buffer plate 24 and support angle 86 may expand at different rates, the second attachment point between the buffer plate and support angle is not a fixed anchor point. Instead, the support angle defines a hole larger than necessary to receive a threaded stud 116 that projects from the buffer plate. The stud is kept from coming free of the hole by a combination of a washer 118 sized larger than the hole and a stover nut 120 that maintains its position once threaded onto the stud 116. This arrangement maintains the buffer plate in position while allowing for differential thermal expansion of the buffer plate and support angle.

A heater support angle 122 is also mounted to the oven wall. The heater support angle defines two holes for receiving threaded heater mounting studs 124, 126 that extend perpendicularly from the electric radiant heater 32. The electric radiant heater is mounted to the heater support angle by means of the heater mounting studs.

A pair of shields 128, 130 protect the sealant and expansion joint areas from direct exposure to the heaters and unnecessary heating of this area.

Referring to FIG. 3, the web 54 enters and leaves the oven chambers 12, 14 through slots 53, 55, 57, 59 in the top wall 56 and bottom wall 58. The slots are approximately 4 inches long and about 4 inches wider than the width of the web to be treated. To minimize air infiltration, adjustable closure strips are provided to minimize open area.

Referring again to FIG. 1, the radiant oven is equipped with vents and means for introducing air from outside of the oven or otherwise creating positive pressure in the space 52 between heaters 34 and 36, as well as in the space between heater 32 and oven wall 22 7 and in the space between heater 38 and oven wall 18. The creation of positive pressure in these spaces helps prevent infiltration of solvent vapors into the nonclassified areas of the oven. The air in these spaces is heated by the electric radiant heaters during operation of the oven. During operation of the oven it is desirable to introduce a stream of pre-heated air into the oven chambers 12 and 14 to flush out the solvent vapors. The air heated by radiant heaters can therefore be transferred by ducts out of the spaces, mixed with outside air if necessary to reduce its temperature, and then directed through the oven chambers to flush out the solvent vapors. In operation, the web is first saturated with the epoxy resin solvent mixture. Referring to FIG. 3, the web 54 travels upward through a first oven chamber 14 and then past a cooling air duct or series of cooling air ducts 132. The cooling of the web reduces mechanical loss of resin as the web travels through a roller assembly 134 before passing downward through a second oven chamber 12. Doors 136, 138 allow access to this upper area. The rate at which the web travels through the oven chambers 12, 14 is calculated based on the height of the oven and the amount of solvent that must be removed from the web.

After passing through the second oven cavity or series of oven cavities, the web is ready for any required secondary treatment, or may be collected on a reel for storage. Typical treatment involves cooling, edge trimming to desired width, and cutting the web into sheets of various lengths. Such treatment of webs is generally known in the art. Webs treated in this way are typically used in the manufacture of electronic circuit board material.

Although the preferred embodiments of the invention have been shown and described, it should be understood that various modifications and rearrangements of the parts may be resorted to without departing from the scope of the invention as disclosed and claimed herein.

What is claimed is:

1. A radiant oven for treating material, said oven comprising electric radiant heaters, oven walls, a bracket, and radiant buffer plates, said buffer plates being connected to the walls, the buffer plates in combination with the walls defining an oven chamber, said oven chamber, during operation of said radiant oven being a classified oven chamber, the bracket receiving an edge of a buffer plate and in combination with insulating sealant and said buffer plates isolating the electric radiant heaters from the oven chamber, said buffer plates being effective to separate, during operation of the radiant oven, the classified oven chamber from an unclassified area in which at least one of said electric radiant heaters is disposed.

2. The oven according to claim 1, wherein said oven is adapted to treat a fiber or web of material being passed therethrough, in which the walls define a top and a bottom, the top defining a first opening and the bottom defining a second opening, said openings sized to allow said fiber or web to pass through for treatment in the oven chamber.

3. The oven according to claim 1, wherein the electric radiant heaters are controlled by a temperature sensing and feedback loop in order to maintain the buffer plates at a temperature between 400° F. and 700° F.

4. The oven according to claim 1, wherein a layer of high emissivity paint is disposed on a side of the buffer plate facing toward the electric radiant heater.

5. The oven according to claim 1, wherein a pair of said buffer plates are on opposite sides of said oven chamber, are substantially parallel, and are about 12 to 30 inches apart.

6. The oven according to claim 5, wherein an electric radiant heater is spaced apart from each of said buffer plates about 1 to 24 inches.

7. The oven according to claim 1, said oven walls comprising interior sheets and exterior sheets, said interior sheets being stainless steel.

8. The oven according to claim 7, wherein said exterior sheets are aluminized steel.

9. The oven according to claim 1, wherein said electric radiant heaters are nonclassified electric radiant heaters.

10. The oven according to claim 1, wherein the height and width of the buffer plate are smaller than the height and width of the oven chamber, allowing for thermal expansion of the buffer plate at the operating temperature of the oven.

11. The oven according to claim 1, wherein the insulating sealant in conjunction with the buffer plates provide a seal effective to maintain a classified area of the oven separate from a nonclassified area of the oven.

12. The oven according to claim 11, further comprising a means for introducing positive air pressure into the nonclassified area of the oven.

13. The oven according to claim 12, further comprising a means for transferring air from said nonclassified area to said oven chamber.

14. The oven according to claim 13, further comprising a means for sensing and controllably adjusting the temperature of the air transferred from said nonclassified area to said oven chamber.

15. A radiant oven for treating material, said oven comprising electric radiant heaters, oven walls, and radiant buffer plates, said buffer plates being connected to the walls, the buffer plates in combination with the walls defining an oven chamber, said oven chamber, during operation of said radiant oven being a classified oven chamber, said buffer plates being stainless steel plates having a thickness between about 0.049 and 0.169 inches, said buffer plates isolating the electric radiant heaters from the oven chamber, said buffer plates being effective to separate, during operation of the radiant oven, the classified oven chamber from an unclassified area in which at least one of said electric radiant heaters is disposed.

16. A radiant oven for treating material, said oven comprising electric radiant heaters, oven walls, and radiant buffer plates, said buffer plates being connected to the walls, the buffer plates in combination with the walls defining an oven chamber, said oven chamber, during operation of said radiant oven being a classified oven chamber, said buffer plates isolating the electric radiant heaters from the oven chamber, said buffer plates being effective to separate, during operation of the radiant oven, the classified oven chamber from an unclassified area in which at least one of said electric radiant heaters is disposed, said oven further comprising a buffer support angle supporting at least one buffer plate.

17. The oven according to claim 16, said buffer support angle having a stud extending perpendicularly from one end of the angle, said oven further comprising a mount for receiving the buffer support angle, said mount defining an elongated slot for receiving said stud and allowing sliding movement of the stud along the long axis of the angle.

18. The oven according to claim 16, wherein said buffer plate has a threaded mounting stud extending perpendicularly from the plane of the plate, said buffer support angle defining a hole larger than said stud, said hole receiving said stud, and an engaging means being attached to the stud, thereby preventing the stud from withdrawing from the hole.

* * * * *